US007403118B2

(12) United States Patent
Belden, Jr.

(10) Patent No.: US 7,403,118 B2
(45) Date of Patent: Jul. 22, 2008

(54) SECURITY DEVICE WITH PERIMETER ALARM

(75) Inventor: Dennis D. Belden, Jr., Waxhaw, NC (US)

(73) Assignee: Checkpoint Systems, Inc., Thorofare, NJ (US)

( * ) Notice: Subject to any disclaimer, the term of this patent is extended or adjusted under 35 U.S.C. 154(b) by 158 days.

(21) Appl. No.: 11/289,246

(22) Filed: Nov. 29, 2005

(65) Prior Publication Data

US 2007/0120669 A1 May 31, 2007

(51) Int. Cl.
*G08B 13/12* (2006.01)

(52) U.S. Cl. ..... 340/568.2; 340/571; 70/57.1

(58) Field of Classification Search ..... 340/568.2, 340/652, 571, 568.1; 70/57.1
See application file for complete search history.

(56) References Cited

U.S. PATENT DOCUMENTS

| | | | | |
|---|---|---|---|---|
| 199,468 | A | | 1/1878 | Rheubottom |
| 596,237 | A | | 12/1897 | Damon |
| 639,196 | A | | 12/1899 | Fehling |
| 673,612 | A | | 5/1901 | Appleby |
| 886,905 | A | | 5/1908 | Ward |
| 895,403 | A | | 8/1908 | Jackson |
| 1,012,882 | A | | 12/1911 | Austin et al. |
| 1,083,612 | A | | 1/1914 | Hooker |
| 1,124,130 | A | | 1/1915 | Grant |
| 1,141,245 | A | | 6/1915 | Gillespie |
| 1,165,320 | A | | 12/1915 | Clary |
| 1,165,816 | A | | 12/1915 | Tichenor |
| 1,601,493 | A | | 9/1926 | Condon |
| 1,657,190 | A | | 1/1928 | Ballou |
| 2,002,946 | A | | 5/1935 | Jacobs |
| 3,214,808 | A | | 11/1965 | Litwin |
| 3,395,555 | A | | 8/1968 | Hickman |
| 3,466,668 | A | | 9/1969 | Ochiai |
| 3,611,760 | A | | 10/1971 | Muther |
| 3,636,739 | A | | 1/1972 | Smedley |
| 3,754,420 | A | | 8/1973 | Oellerich |
| 3,772,674 | A | * | 11/1973 | Jackson ..... 206/459.1 |
| 3,831,407 | A | | 8/1974 | Coleman |
| 3,872,547 | A | | 3/1975 | Caveney et al. |
| 3,906,758 | A | | 9/1975 | Hurwitt |
| 4,070,879 | A | | 1/1978 | Thompson |
| 4,071,023 | A | | 1/1978 | Gregory |
| 4,086,795 | A | | 5/1978 | Foster et al. |
| 4,128,220 | A | | 12/1978 | McNeel |
| 4,191,334 | A | | 3/1980 | Bulanda et al. |
| 4,196,424 | A | | 4/1980 | Williamson |

(Continued)

FOREIGN PATENT DOCUMENTS

| | | |
|---|---|---|
| DE | 2725580 | 12/1977 |
| SE | 123470 | 11/1948 |

*Primary Examiner*—Davetta W. Goins
*Assistant Examiner*—Hongmin Fan
(74) *Attorney, Agent, or Firm*—Sand & Sebolt

(57) ABSTRACT

A security device for attachment to an article to deter theft has a housing containing an alarm system including an audible alarm speaker. The alarm system includes a conductor located within the housing which forms a loop that extends at least partially about the alarm speaker or about the periphery of the housing. The conductor which can be an electrical conductor, fiber optic conductor, light pipe, etc., when severed by a thief will actuate the audible alarm.

17 Claims, 5 Drawing Sheets

U.S. PATENT DOCUMENTS 4,287,644 A 9/1981 Durand
4,299,870 A 11/1981 Humble
4,418,551 A 12/1983 Kochackis
4,499,680 A 2/1985 Coburn
4,500,124 A 2/1985 Swift
4,506,415 A 3/1985 Swift
4,580,319 A 4/1986 Paradis
4,631,782 A 12/1986 Gecs
4,708,306 A 11/1987 Mitomi
4,736,604 A 4/1988 Zeller et al.
4,756,171 A 7/1988 Homar
4,813,105 A 3/1989 Espinoza
4,823,442 A 4/1989 Behr
4,825,156 A 4/1989 Read
4,833,807 A 5/1989 McLean
4,893,853 A 1/1990 Guiler
4,896,517 A 1/1990 Ling
4,897,899 A 2/1990 Shely et al.
4,919,373 A 4/1990 Caveney et al.
4,929,006 A 5/1990 Tsay
4,930,324 A 6/1990 Meier
4,944,475 A 7/1990 Ono et al.
4,949,679 A 8/1990 Wolfer
4,958,414 A 9/1990 Benoit
4,962,369 A 10/1990 Close
5,042,114 A 8/1991 Parrish
5,068,643 A 11/1991 Yashina
5,079,540 A 1/1992 Narlow et al.
5,119,652 A 6/1992 Costa
5,121,524 A 6/1992 Mortensen
5,123,686 A 6/1992 Wenk
5,144,820 A 9/1992 Holmgren
5,144,821 A 9/1992 Ernesti et al.
5,156,028 A 10/1992 Jiang
5,193,368 A 3/1993 Ling
5,230,541 A 7/1993 Nowak
5,279,136 A 1/1994 Perry
5,293,668 A 3/1994 Tibiletti
5,337,459 A 8/1994 Hogan
5,337,503 A 8/1994 Goby
5,345,947 A 9/1994 Fisher
5,377,388 A 1/1995 DeBever
5,379,496 A 1/1995 Krauss
5,413,393 A 5/1995 Georgopoulos et al.
5,421,177 A 6/1995 Sieber et al.
5,431,393 A 7/1995 Wang
5,437,172 A 8/1995 Lamy et al.
5,440,904 A 8/1995 Su
5,517,835 A 5/1996 Smith
5,517,836 A 5/1996 Hong
5,524,463 A 6/1996 Schenkel et al.
5,551,447 A 9/1996 Hoffman et al.
5,568,951 A 10/1996 Morgan
5,570,080 A 10/1996 Inoue et al.
5,581,853 A 12/1996 Miller et al.
5,589,819 A 12/1996 Takeda
5,610,587 A * 3/1997 Fujiuchi et al. ..... 340/568.2
5,627,520 A 5/1997 Grubbs et al.
5,671,506 A 9/1997 Eliasson
5,687,455 A 11/1997 Alexander
5,687,456 A 11/1997 Chang
5,722,266 A * 3/1998 Yeager et al. ..... 70/57
5,764,147 A 6/1998 Sasagawa et al.
5,767,773 A 6/1998 Fujiuchi et al.
5,794,464 A 8/1998 Yeager et al.
5,850,752 A 12/1998 Lax
5,856,782 A 1/1999 Sasagawa et al.
5,864,290 A 1/1999 Toyomi et al.
5,951,047 A 9/1999 Dungan
5,969,613 A 10/1999 Yeager et al.
6,052,876 A 4/2000 Hogan et al.
6,069,563 A * 5/2000 Kadner et al. ..... 340/571
6,092,401 A 7/2000 Sankey et al.
6,128,932 A 10/2000 Mainetti et al.
6,177,869 B1 1/2001 McDaid
6,227,016 B1 5/2001 Yu
6,363,758 B1 4/2002 Ling
6,420,971 B1 7/2002 Leck et al.
6,422,387 B1 7/2002 Sedon et al.
6,449,991 B1 9/2002 Hogan
6,523,228 B1 2/2003 Benoit
6,624,753 B2 9/2003 Elston
2005/0253686 A1 * 11/2005 Shafer et al. ..... 340/10.1

* cited by examiner

SECURITY DEVICE WITH PERIMETER ALARM

BACKGROUND OF THE INVENTION

1. Technical Field

The invention relates to theft deterrent devices, and particularly to a device which wraps around, through or attached to a protected article with a security cable. Even more particularly, the invention relates to such a security device which includes an internal alarm system which is actuated if the cable is cut, and which includes an alarm conductor which extends about the perimeter of the security device or around the speaker of an audible alarm which will actuate the audible alarm if an attempt is made to cut through the device or the audible alarm speaker contained therein.

2. Background Information

Various retail establishments use numerous types of theft deterrent systems and devices to discourage shoplifting. Many of these devices attach to the article to be protected by cables which wrap around the device or extend through portions of the device or is secured thereto in other manners. The device will sound an alarm if the security device itself is tampered with, such as cutting the attachment cable. Also, the security devices will carry an EAS tag which will actuate an alarm of a security gate that is usually located at the exit of the retail establishment.

These security devices contain an alarm system which includes an audible alarm which emits a high pitched alarm sound through a speaker, such as a piezoelectric speaker, mounted in the security device. The alarm alerts store personnel that the article being protected thereby is being tampered with, as well as possible tampering of the security device itself. It has been found that some shoplifters having certain knowledge of the particular security device used thereon, will deactivate the audible alarm speaker or portions of the security device by use of snips or other tools which will cut through the housing of the security device, which is usually formed of a rigid plastic. The snips will deactivate the speaker or other portions of the security alarm so that when the article is removed from the store or from the protected article, the alarm will not be sounded. Even though the housings of the security devices are rigid plastic, the snips which are usually used for metal working can cut through the housing to disarm the speaker and/or circuitry of the security device.

Thus the need exists for a security device, which in addition to providing the desired alarm system to a protected article, also incorporates a protection to prevent a shoplifter from disabling the alarm speaker and/or alarm circuitry by cutting through the housing of the security device with snips or other cutting mechanisms.

BRIEF SUMMARY OF THE INVENTION

One aspect of the present invention is to provide an alarm security device which is easily placed about an item of merchandise to be protected thereby by one or more cables, and which is easily removed from the protected device at a checkout station, and which may contain an EAS tag enabling the device to be reusable numerous times on various items of merchandise.

Another aspect of the invention is that the security device includes a housing usually formed of a rigid plastic material, which is protected by an alarm conductor such as an electrical conductor or a fiber optic conductor extending about the perimeter of the housing and/or about the internal audible alarm speaker, which if severed by a thief attempting to cut through the housing and/or speaker, will actuate the alarm, preventing disabling the security device in such a manner.

Still another aspect of the invention is to provide such a security device in which the cable can be attached by a plug insertable into the security device housing and secured by a magnetically attractable locking mechanism, or which includes a plurality of cables which are placed about an object and tightened thereabout by use of a ratchet mechanism contained within the security device.

A further aspect of the invention is to provide the perimeter security and alarm feature by use of a single electrical conductor or fiber optic rod or cable which can be located in one of the side walls of the security device housing or placed about the audible alarm speaker, and connected to the appropriate circuitry or internal circuit board which provides the alarm system for the security device.

These features are obtained by the security device of the present invention, the general nature of which may be stated as a device adapted to be secured to an object comprising a housing, a cable loop extending from the housing for attachment to the object; an alarm system contained in the housing, the alarm system including an audible alarm; and an alarm conductor operationally connected to the alarm system and extending in a continuous loop configuration within the housing and about a portion of the housing and when severed will actuate the audible alarm.

BRIEF DESCRIPTION OF THE SEVERAL VIEWS OF THE DRAWINGS

Preferred embodiments of the invention, illustrative of the best modes in which Applicant contemplates applying the principles, are set forth in the following description and are shown in the drawings and are particularly and distinctly pointed out and set forth in the appended claims.

Similar numbers refer to similar parts throughout the specification.

DETAILED DESCRIPTION OF THE INVENTION

Figure 1:
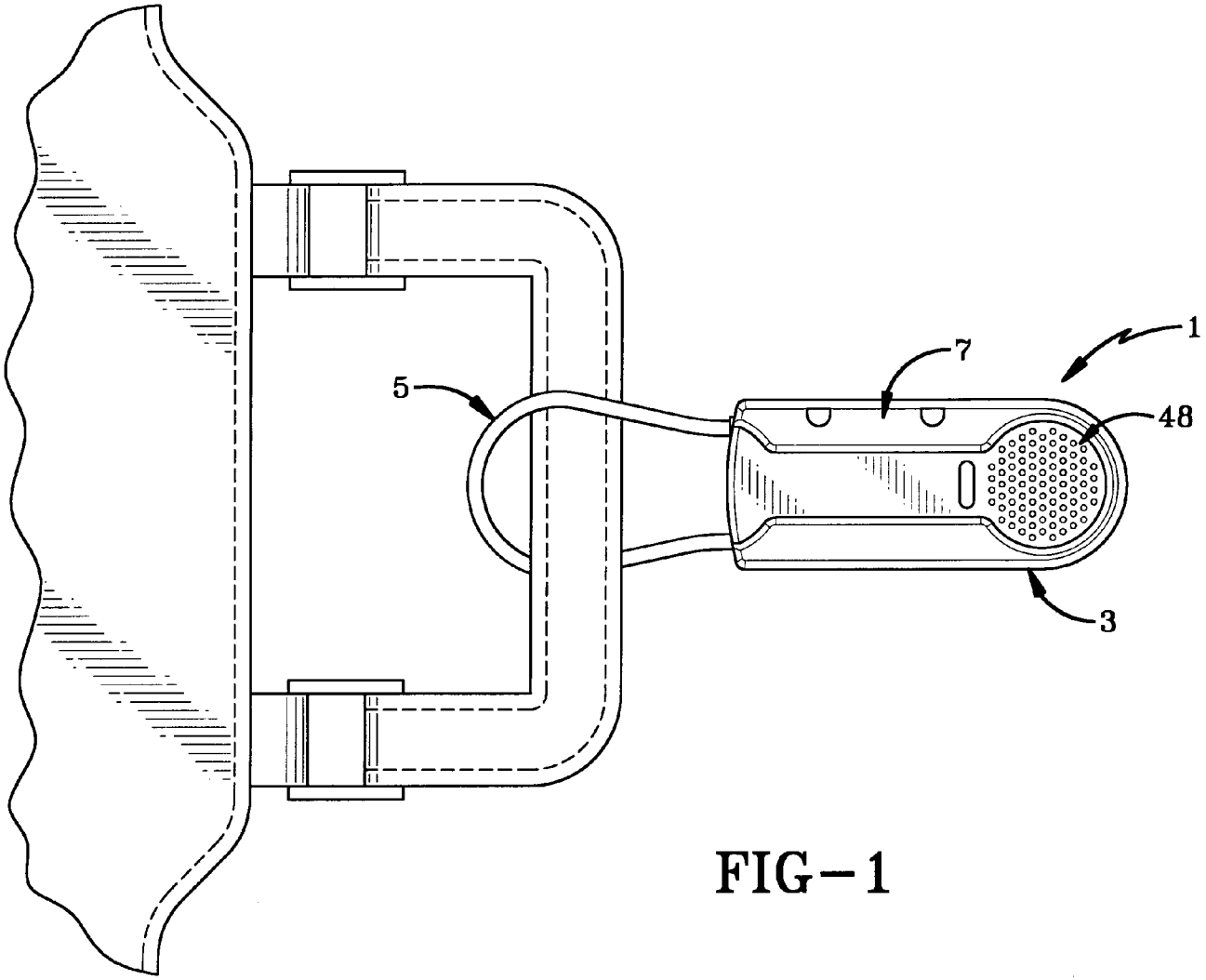
FIG. 1 is a diagrammatic illustration showing one type of security device of the present invention which is attached by a cable to an article to be protected thereby.

A first embodiment of the improved security device of the present invention is shown in FIGS. 1-4, and is indicated generally at 1, and is referred to broadly as a cable alarm device. Device 1 is very similar to the device shown in pending provisional application Ser. No. 60/644,195, filed Jan. 14, 2005, the contents of which are incorporated herein by reference. Device 1 includes a housing 3 and a locking cable 5. Housing 3 includes two generally half body components 7 and 8, preferably formed of a rigid plastic material and secured together by an adhesive, sonic weld or the like. Device 1 has an internal compartment 9 in which is mounted an alarm system indicated generally at 11 (FIGS. 2 and 3), and a lock mechanism indicated generally at 13.

Housing 3 has a relatively elongated flat configuration wherein the thickness is considerable less than its length. This provides a relatively compact, yet pleasingly attractive device. Lower half body portion 8 (FIGS. 2 and 3) includes an outer peripheral wall indicated generally at 15, having straight side segments 14, a curved top section 16 and a lower end section 17. The two half body members may have positioning posts 21 which extend into bosses formed on the opposite housing member to properly align the members together before final joinder thereof.

Figure 2:
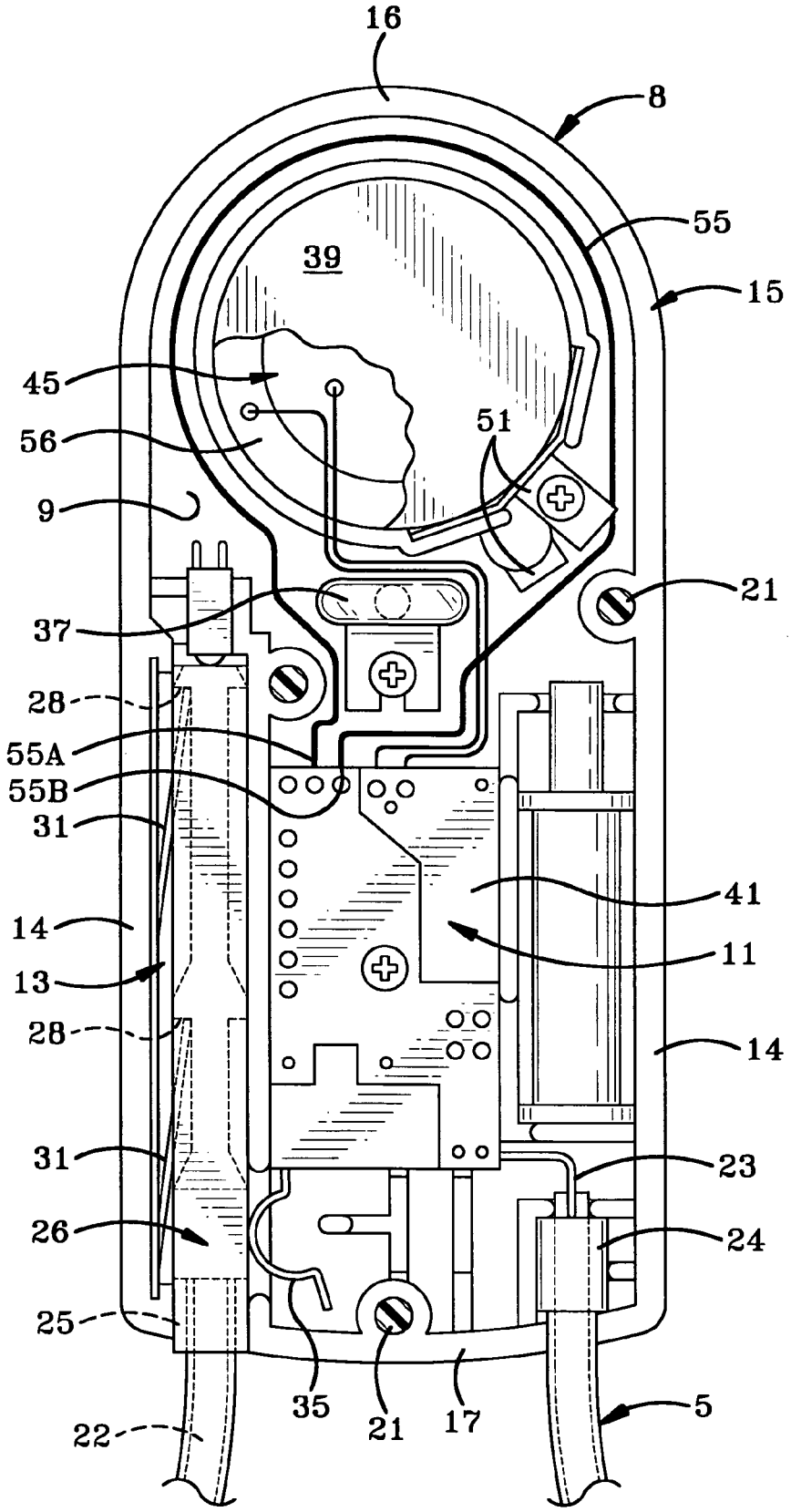
FIG. 2 is an enlarged plan view of the security device of FIG. 1 with a one half portion of the housing removed therefrom, and with the conductor alarm extending about the audible alarm speaker.
Figure 3:
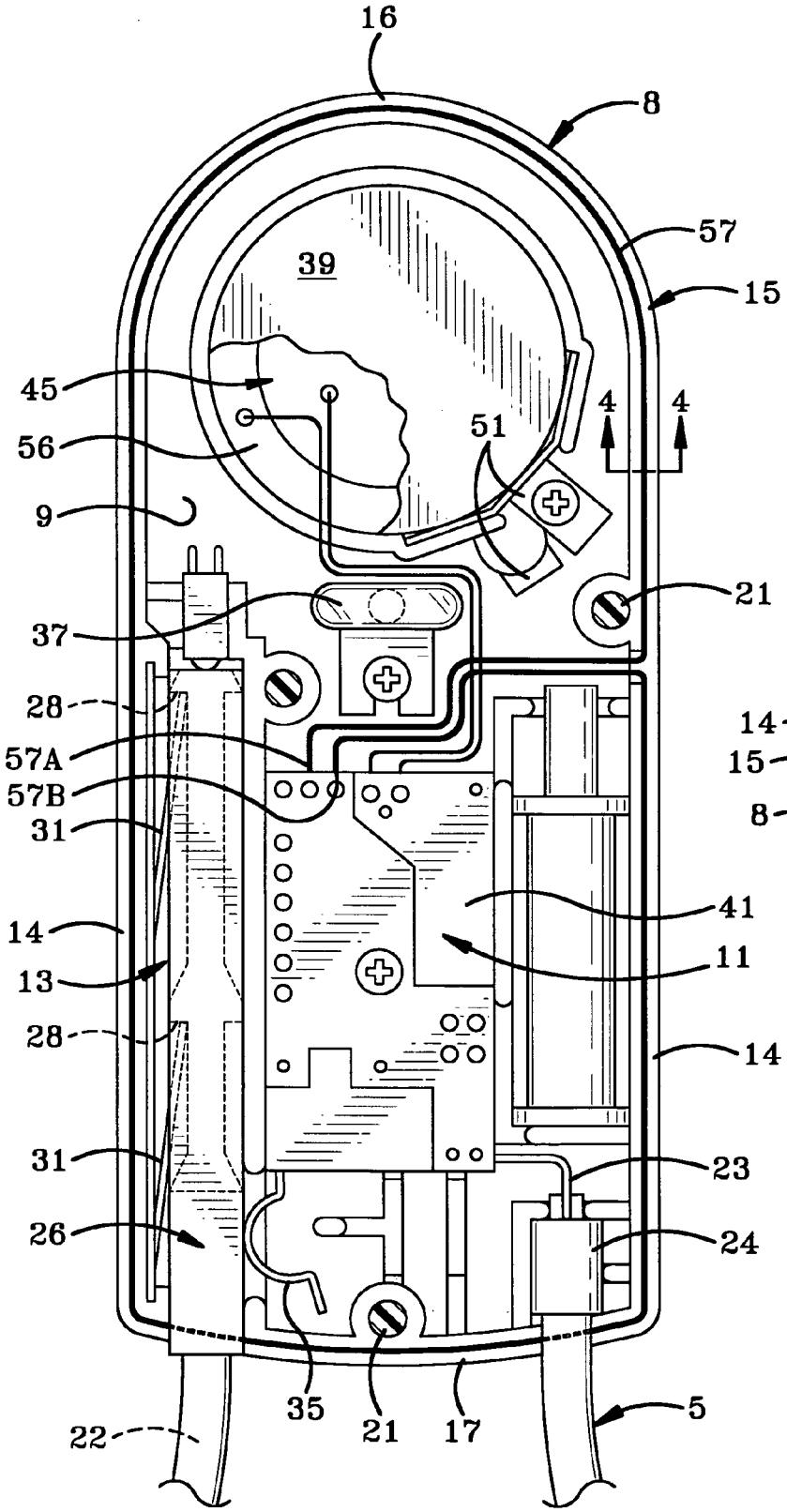
FIG. 3 is a view similar to FIG. 2 showing another embodiment in which the conductor alarm extends around the periphery of the housing of the security device.

Locking cable 5 includes an internal conductive cable 22 covered by a dielectric insulation with a first end being connected to an electrical connector 24 and the second end being connected to an electrical connector 25, which connector forms an end of a locking plug 26. Locking plug 26 preferably is formed of a dielectrical material and has a pair of locking shoulders 28 formed thereon, which when in the locked position, engage a pair of spring biased metal tines 31. Tines 31 are magnetically attractable by a magnet when placed proximate thereto to remove them from their locking engagement with shoulders 28 to enable locking plug 26 to be removed from its locked position within housing 3. As shown in FIGS. 2 and 3, connector 24 is connected to alarm system 11 by a conductor 23, and connector 25 is electrically connected to the alarm system by a spring metal clip 35. An LED 37 may be mounted within compartment 9 and electrically connected to a battery 39 through a printed circuit board 41 which forms the basis of alarm system 11, which alarm system and circuitry thereof will be of a usual construction well-known to those skilled in the alarm security art.

An audible alarm 45, and in particular speaker 56 thereof, is located within a circular boss formed in housing 3 adjacent a perforated area 48 which forms a grill-like structure in housing body half member 7 through which an alarm sound is emitted. Battery 39 supplies the electrical power for the alarm system 11 through terminals 51. The other components of security device 1 and alarm system 11 and their manner of operation are the same as that described in the above-referenced provisional application Ser. No. 60/644,193.

In accordance with the invention, alarm conductor 55 is mounted on the inside surface of one of the half body members, preferably half body member 8, and extends in a loop-like manner partially about audible alarm speaker 56. First and second ends 55A and 55B of conductor 55 are connected to printed circuit board 41 of alarm system 11 as shown in FIG. 2. Conductor 55 in the preferred embodiment is an electrical conductor and is a relatively thin wire of solid or braided metal such as copper, covered by a dielectric material and will be electrically energized when the security device is activated. However, conductor 55 can be a fiber optic rod or cable, a light pipe, etc. without affecting the concept of the present invention. Thus, should conductor 55 be severed or pulled loose from circuit board 41, it will actuate the audible alarm. This prevents a thief from using a pair of snips or the like to disarm the audible speaker since prior to cutting through alarm speaker 56 it will sever conductor 55 actuating the alarm just prior to the speaker being disabled. Thus, when an alarm sound is emitted, even for a relatively very short period of time, it may be sufficient to alert store personnel that a theft is in progress and/or discourage the thief from continuing cutting through the housing.

Figure 4:
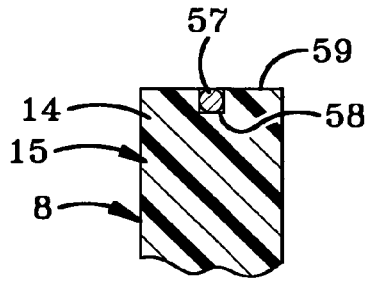
FIG. 4 is an enlarged fragmentary sectional view taken on line 4-4, FIG. 3.
Figure 5:
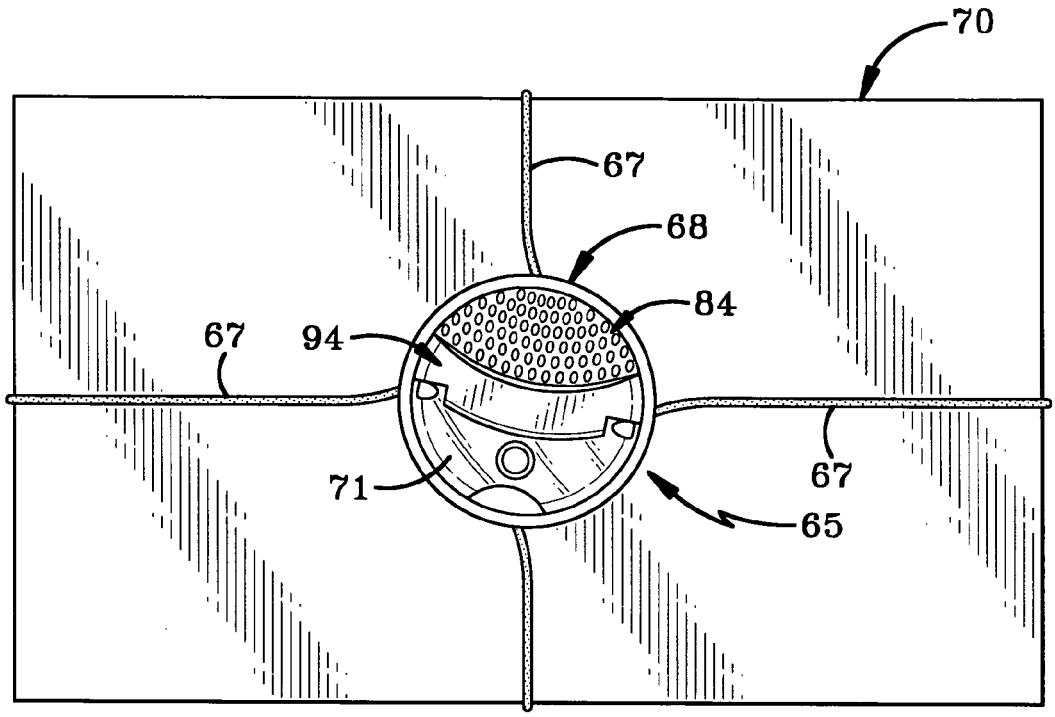
FIG. 5 is a diagrammatic illustration of another type of security device of the present invention which is mounted on a package.
Figure 6:
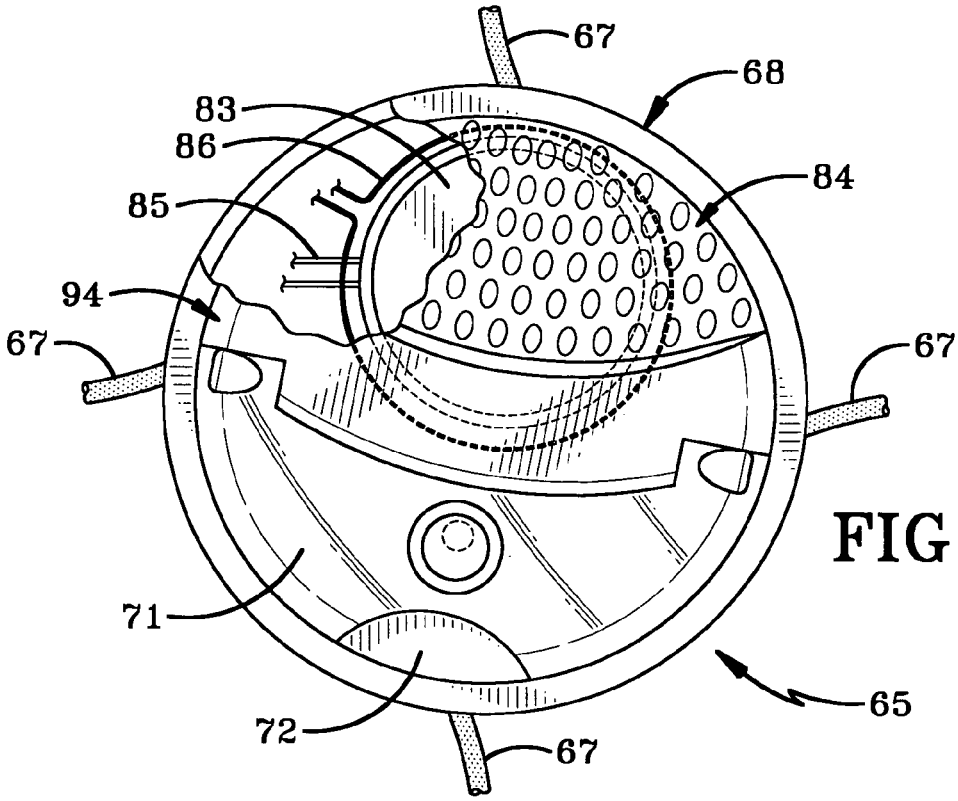
FIG. 6 is an enlarged view of the security device of FIG. 5 with portions broken away showing the conductor alarm extending about the audible alarm speaker.
Figure 8:
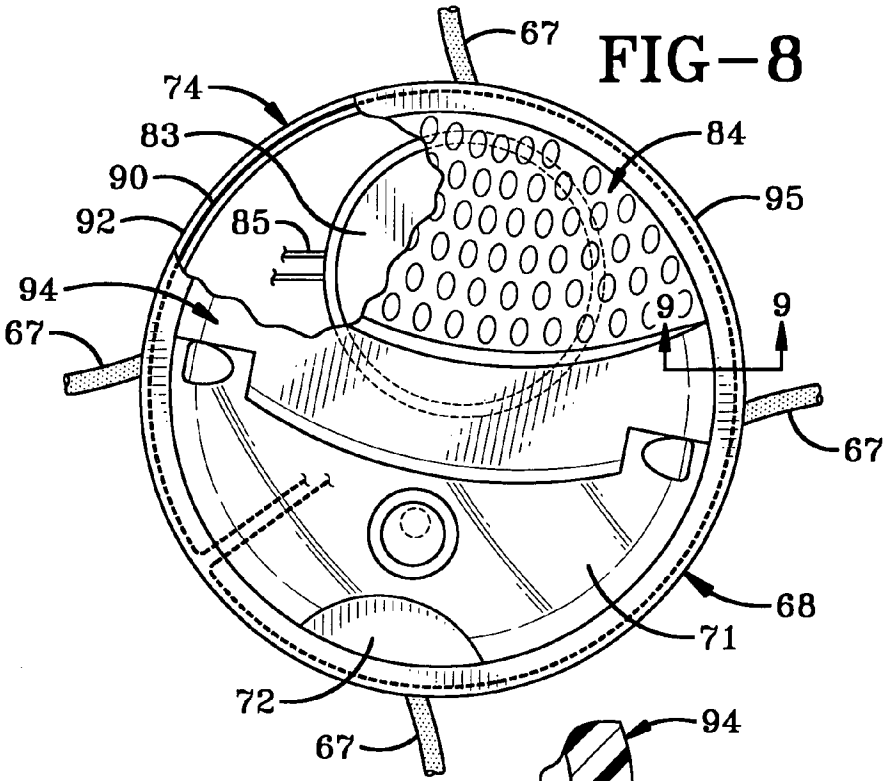
FIG. 8 is a top plan view with portions broken away, of the security device of FIG. 5, with the conductor alarm extending about the outer periphery of the housing of the security device.
Figure 9:
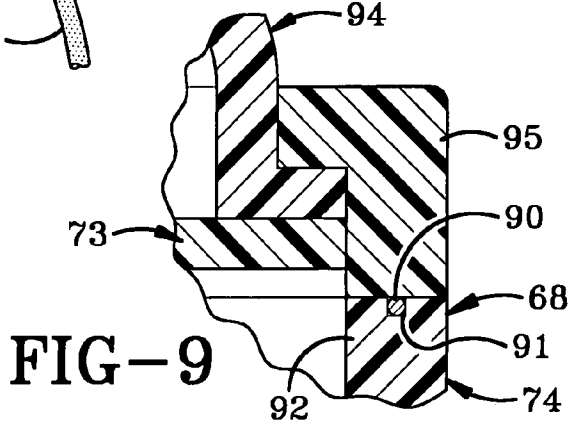
FIG. 9 is an enlarged fragmentary sectional view taken on line 9-9, FIG. 8.

A slightly modified version of the improved security device is shown in FIGS. 3 and 4, in which an alarm conductor 57 extends about the periphery of one of the housing members such as lower body member 8, where it is connected by ends 57A and 57B to the alarm system 11. Conductor 57 may be located within a shallow groove or recess 58 formed in a top surface of perimeter wall 14 of body member 8. Conductor 57 also will be energized when security device is activated and will sound the audible alarm immediately upon being severed by someone attempting to cut through housing 3 with a pair of snips or other type of severing device.

Thus, conductors 55 and 57 provide for a very simple additional security measure which can be mounted within a type of cable alarm security device as shown in FIGS. 1-4, by placing the alarm conductor in a general loop fashion about the perimeter of the audible alarm speaker and/or about the external periphery of the housing of the security device. This requires only the use of a thin electrical conductor, fiber optic rod or cable, light pipe, etc. and its attachment to the appropriate circuitry of alarm system 11.

A second embodiment of the improved security device is indicated generally at 65, and is shown in FIGS. 6-9. Security device 65 is very similar to the device disclosed in pending patent application Ser. No. 11/023,721, filed Dec. 28, 2004, the contents of which are incorporated herein by reference. This type of device is referred to a cable wrap security device in that it includes a plurality of cables 67 which extend outwardly from a housing 68. The cables wrap around an object such as a box 70, where they are tightly secured by a ratchet mechanism contained within housing 68, the details of which are clearly shown and described in said pending patent application Ser. No. 11/023,721.

Housing 68 will include a flip-up handle 71 which is mounted on a dome-shaped top wall cover plate portion 72 of housing 68, which when in the raised operative position will enable the cables to be tightened about package 70. Top wall portion 72 is attached to a ratchet mechanism which includes a spool 73 so as to rotate therewith, and which is rotatably mounted on a disc-shaped base 74. Cable lock 65 will include an internal alarm system indicated generally at 75, and shown diagrammatically in FIG. 7. Alarm system 75 includes a plurality of electrical connectors 76 attached to each end of cables 67 which are electrically connected through a conductor 77 to a printed circuit board 80 which forms and contains the basic components of alarm system 75. A printed circuit board 80 is connected to a battery 81 which is mounted on spool 73. Battery 81 is connected to an audible alarm containing a speaker 83, which is located adjacent and behind a perforated grille 84 (FIG. 8), by conductors 85. The audible alarm emits a high pitched alarm signal should the integrity of any of the cables 67 be compromised or if an EAS tag (not shown) mounted in housing 68 pass in an unauthorized manner through a security gate.

Figure 7:
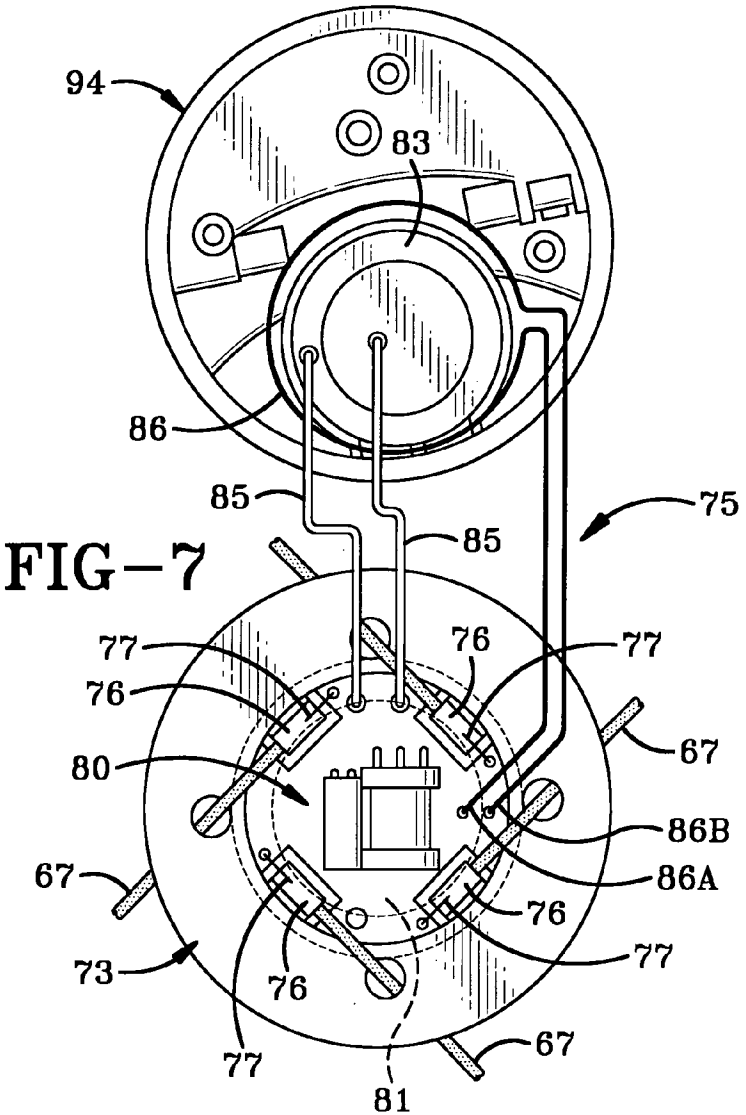
FIG. 7 is a partially exploded view of the top wall cover plate and alarm circuitry mounting plate of the security device of FIG. 6.

In accordance with the main feature of the present invention, an alarm conductor 86 extends in close proximity to and in a loop fashion about speaker 83 and is connected to printed circuit board 80 by end 86A and 86B (FIG. 7). Thus, if someone attempts to cut into housing 68 to damage speaker 83, it will first sever conductor 86 which will sound the alarm sufficiently in advance to being damaged to alert the store personnel.

In a slightly modified arrangement of embodiment 65 (FIGS. 8 and 9), an alarm conductor 90 is mounted in a recess 91 formed in the upper portion of a cylindrical side wall 92 of housing base 74. Dome-shaped top wall portion 72, in which grille-like portion 84 is formed and spool 73, are rotably mounted on housing base 74 and secured thereto by a lock ring 95. Thus a thief attempting to cut through housing 68 in an attempt to disable the internal alarm or alarm speaker will initially sever conductor 90 which will actuate the audible alarm to alert the store personnel.

In summary, the security device of the present invention enables a simple conductor to be mounted either about the periphery of the housing or other structural components which form the security device, or around and in close proximity to the audible alarm speaker, so that when the alarm conductor is severed by a thief attempting to cut through the security device housing and/or speaker will immediately actuate the alarm system to emit a high pitched alarm signal. This additional feature is achieved by the relatively simple effective use of a single electrical conductor, fiber optic conductors, etc. arranged in a loop-like fashion at a selected location within the housing of the security device and connected to the existing internal alarm circuitry which maintains the conductor energized when the alarm system is activated resulting in the sounding of the alarm if the integrity of the conductor is compromised, such as being severed or pulled away from its connection to the printed circuit board of the alarm system.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A security device adapted to be secured to an object, said device comprising:
- a housing;
- a cable loop extending from the housing for attachment to the object;
- an alarm system contained in the housing, said alarm system including a speaker to produce an audible alarm responsive to a tampering condition of said cable loop; and
- a conductor operationally connected to the alarm system and extending in a continuous loop configuration within the housing and about a portion of said housing and about the speaker and when severed will actuate the audible alarm so as to protect tampering of the speaker.

2. The security device defined in claim 1 wherein the conductor extends about and closely adjacent the periphery of the housing.

3. The security device defined in claim 1 wherein the housing includes two body components formed of plastic; in which at least one of said body components has an outer peripheral wall; and in which the conductor is located within the peripheral wall of said one body component.

4. The security device defined in claim 1 wherein the housing has an annular configuration with a base formed of a rigid plastic and a top wall cover plate, said base including a side wall; and in which a ratchet mechanism is located within the base and operationally connected to the cable loop for securing said cable loop about the object.

5. The security device defined in claim 4 wherein the conductor extends about and within the side wall of the base.

6. The security device defined in claim 4 wherein the conductor is mounted on and extends about an inside surface of the top wall cover plate.

7. The security device defined in claim 1 wherein the speaker is mounted on the top wall cover plate.

8. The security device defined in claim 1 wherein the cable loop has a first end connected to the housing and a second end connected to a plug, said plug being selectively connectable to and removable from the housing; and in which the alarm system is operatively connected to the cable loop to sound an audible alarm contained within the housing when the integrity of the cable is compromised.

9. The security device defined in claim 8 wherein a locking mechanism is mounted within the housing and engageable with the plug to lock the plug to the housing.

10. The security device defined in claim 1 wherein the alarm system includes a printed circuit board mounted within the housing; and in which the conductor is an electrical conductor having first and second ends electrically connected to the circuit board.

11. A security device adapted to be secured to an object, said device comprising:
- a housing;
- an attachment device on the housing for attaching the housing to the object;
- an alarm system contained in the housing, said alarm system including a speaker located adjacent a grille formed in the housing, to produce an audible alarm responsive to a tampering condition of said attachment device; and
- a conductor operationally connected to the alarm system and extending in a continuous loop configuration within the housing and about a portion of said housing and about the speaker, whereby said conductor when severed will actuate the audible alarm so as to protect tampering of the speaker.

12. The security device defined in claim 11 wherein the conductor extends about and closely adjacent the periphery of the housing.

13. The security device defined in claim 11 wherein the housing includes two body components formed of plastic; in which at least one of said body components has an outer peripheral wall; and in which the conductor is located within the peripheral wall of said one body components.

14. The security device defined in claim 13 wherein a recess is formed in the peripheral wall of said one body component; and in which the conductor is located within the recess.

15. The security device defined in claim 11 wherein the conductor is an electrical conductor; and wherein a battery is located in the housing to provide electric power to the alarm system and electrical conductor loop.

16. The security device defined in claim 11 wherein the conductor is mounted on and extends about an inside surface of a top wall cover plate of the housing.

17. The security device defined in claim 11 wherein the conductor is a fiber optic conductor.

* * * * *